US011647842B2

(12) United States Patent
Kelly

(10) Patent No.: US 11,647,842 B2
(45) Date of Patent: May 16, 2023

(54) WALL BED WITH A FIREPLACE AND AN ADJUSTABLE WORKSTATION

(71) Applicant: William Joseph Kelly, Villa Park, IL (US)

(72) Inventor: William Joseph Kelly, Villa Park, IL (US)

( * ) Notice: Subject to any disclaimer, the term of this patent is extended or adjusted under 35 U.S.C. 154(b) by 0 days.

(21) Appl. No.: 17/479,283

(22) Filed: Sep. 20, 2021

(65) Prior Publication Data

US 2022/0167750 A1 Jun. 2, 2022

Related U.S. Application Data

(60) Provisional application No. 63/054,209, filed on Jul. 20, 2020.

(51) Int. Cl.

| | |
|---|---|
| ***A47C 17/38*** | (2006.01) |
| ***A47C 17/42*** | (2006.01) |
| ***A47C 17/44*** | (2006.01) |
| ***A47C 17/48*** | (2006.01) |
| ***A47C 17/50*** | (2006.01) |
| ***A47C 17/46*** | (2006.01) |
| ***A47C 17/60*** | (2006.01) |
| ***A47C 17/62*** | (2006.01) |
| ***A47C 17/40*** | (2006.01) |

(52) U.S. Cl.

CPC ..... *A47C 17/46* (2013.01); *A47C 17/40* (2013.01); *A47C 17/60* (2013.01); *A47C 17/62* (2013.01)

(58) Field of Classification Search

CPC ..... A47C 17/38; A47C 17/42; A47C 17/44; A47C 17/46

See application file for complete search history.

(56) References Cited

U.S. PATENT DOCUMENTS 298,873 A * 5/1884 McClure ..... A47C 17/40 5/53.3
537,869 A * 4/1895 Teel ..... A47C 17/40 5/164.1

(Continued)

FOREIGN PATENT DOCUMENTS

GB 2406506 A 4/2005
GB 2466977 A 7/2007

*Primary Examiner* — Peter M. Cuomo
*Assistant Examiner* — Ifeolu A Adeboyejo
(74) *Attorney, Agent, or Firm* — Bold IP, PLLC; Binita Singh

(57) ABSTRACT

A wall bed is configured to allow a user to maximize a living space with a functional bed that can transform from daytime use to nighttime use. The wall bed is configured to function and serve a plurality of purposes as an entertainment center, a bedroom, or an office and is easily operable between these purposes with simple movements. The wall bed system comprises of a fireplace that has an embedded television which can function both as a television and be used to simulate an active fire via an external source connected to the television. Additionally, the fireplace feature may be removed with ease and transferred to another part of the room. The wall bed also comprises of an adjustable workstation where a height of the workstation may be adjusted to suit a user to work either standing up or sitting down. The wall bed also comprises of a bed and other fixtures such as and not limited to a mirror and an artwork.

16 Claims, 5 Drawing Sheets

(56) References Cited

U.S. PATENT DOCUMENTS

| | | | | | |
|---|---|---|---|---|---|
| 780,569 | A * | 1/1905 | Mackenzie | A47C 17/40 | 5/162 |
| 2,607,046 | A * | 8/1952 | Driver | A47C 17/40 | 5/2.1 |
| 2,671,230 | A * | 3/1954 | Potter | A47C 17/62 | 5/2.1 |
| 2,682,060 | A * | 6/1954 | Driver | A47C 17/40 | 5/43 |
| 3,512,314 | A * | 5/1970 | George | E04H 1/12 | 52/36.2 |
| 5,033,134 | A * | 7/1991 | Burchett | A47C 17/52 | 5/167 |
| 5,036,558 | A * | 8/1991 | Lameka | A47C 17/52 | 5/160 |
| 5,353,452 | A * | 10/1994 | Rulis | A47C 17/40 | 5/160 |
| 7,937,787 | B2 | 5/2011 | Whitford | | |
| 8,152,258 | B2 * | 4/2012 | Kang | F25D 25/04 | 211/187 |
| 8,474,193 | B2 | 7/2013 | Sutton et al. | | |
| 8,613,349 | B1 * | 12/2013 | Halko | A45C 9/00 | 280/37 |
| 9,498,055 | B2 * | 11/2016 | Distefano | A47B 13/088 | |
| 10,058,170 | B2 | 8/2018 | Gosling et al. | | |
| 2005/0055770 | A1 | 3/2005 | Reppas et al. | | |
| 2010/0060125 | A1 * | 3/2010 | Kang | A47B 57/06 | 312/408 |
| 2013/0233841 | A1 * | 9/2013 | Gallo | F24H 3/0411 | 219/201 |
| 2014/0310873 | A1 * | 10/2014 | Gosling | A47B 5/04 | 297/14 |
| 2014/0338120 | A1 | 11/2014 | Baugh et al. | | |
| 2015/0211228 | A1 | 7/2015 | Gosling et al. | | |
| 2019/0133329 | A1 * | 5/2019 | Blom | A47C 20/08 | |

* cited by examiner

WALL BED WITH A FIREPLACE AND AN ADJUSTABLE WORKSTATION

CROSS REFERENCE TO RELATED APPLICATION

This application claims benefit of U.S. Provisional Application No. 63/054209 filed on Jul. 20, 2020, which is incorporated by reference in its entirety.

FIELD OF DISCLOSURE

The overall field of this invention generally relates to a wall bed assembly, and more specifically, to a wall bed assembly having an integrated fireplace feature which is movable from the wall bed, a vertically adjustable workstation, and other features that can be used to customize the wall bed to a user's preference.

BACKGROUND

Living spaces are becoming relatively smaller due to the exponential rise in the cost of real estate. Lifestyles and the high-tech age are driving people to bigger and more populous cities. The same factors are also driving the cost of homes and apartments in these cities. At the same time, people are looking to simplify their busy lives by moving closer to their jobs, which may be in an urban setting or simplify their lives by getting smaller homes. In all these situations, the living environments are often less spacious. As such, convertible furniture, such as a wall bed is a useful and beneficial piece of furniture. Generally, a wall bed is a bed that is hinged at one end to store vertically against a wall, or inside a closet or cabinet. Wall beds serve the purpose of transforming a living space from day to night and thus turning the room into a multifunctional space to maximize space.

Over the years, wall beds have become much more than simple platforms that fold down from the wall. Wall bed designs now integrate shelving, desks, tables, and seating to maximize space and functionality. Some wall beds may be designed with a space to mount a television. The shelving, desks, tables, and seating may include fold out or fixed in place options. However, in these wall beds with integrated features, the television mounted on the wall bed is only usable when the wall bed is in the closed position. With limited budgets or limited space, some individuals may not be able to afford another television to watch when in bed or in a part of the room where the view is not clear to the wall bed mounted television. Additionally, with a lifestyle trending toward working from home, individuals would also like some flexibility with adjusting the height of their workstations to their ergonomic working position or even have the option to adjust from a sit to stand position or vice versa. These options are not presented and thus unavailable with the wall beds currently in use.

Hence, there exists a need for an improved wall bed which includes features that are more versatile and addresses the significant reduction in living space requirements.

SUMMARY

Accordingly, the present disclosure recognizes the unsolved need for an improved wall bed and more versatile wall bed that accommodates features for the modern lifestyle including and not limited to a reduction in living space and the trend of working from home. The present disclosure combines a bed, office, and entertainment center into a living space. The invention as presently described will have multiple uses and will allow the room to simulate the appearance of a family room, living room, bedroom, or office with simple movements. Thus, this invention addresses the significant reduction in living space requirements and associated cost per square feet. This invention also addresses the current trend of working from home. Additionally, this invention also addresses accommodating group living arrangements.

In a non-limiting preferred embodiment, a wall bed system is provided which comprises of a cabinet, a rotation module with a bed, a removable fireplace, an adjustable workstation, and one or more televisions. The cabinet and the rotation module are coupled to each other at a left side and a right side of the cabinet with a hinge that may utilize a wall bed lift mechanism which lowers and raises the rotation module between a horizontal and vertical positions, respectively. A fulcrum, which is an enclosed box located at a bottom end of the cabinet and extends from a left side to a right side of the cabinet is positioned relatively below where the cabinet and rotation module are coupled to each other. The fulcrum is affixed at the bottom end of the cabinet to enclose any hardware mechanism necessary to raise and lower the rotation module, electrical wiring, and offer support to the rotation module when the rotation module is in a horizontal or lowered position. When the rotation module is in a vertical position, the rotation module is stowed in the cabinet and together the cabinet and the rotation module form an enclosed box.

The cabinet is permanently affixed to a wall in a room and further comprises of a canopy which is configured with one or more light fixtures. The cabinet may further comprise of one or more fixtures within the cabinet. The one or more fixtures may include and not be limited to a television, a mirror, a picture frame, or a painting that are visible when the rotation module with the bed is lowered into a horizontal position. The rotation module contains the bed which is stowed within the cabinet when in a vertical position. The rotation module pulls down from the stowed vertical position away from the cabinet to a horizontal position to present the bed.

The rotation module comprises of an inner side and an outer side. The inner side faces within the cabinet and contains the bed. The outer side of the rotation module faces a room when the rotation module is in the vertical position wherein the rotation module is folded upward in toward the cabinet to form the enclosed box The outer side of the rotation module comprises of one or more fixtures. In a non-limiting embodiment, the outer side of the rotation module may comprise of a fireplace feature, an adjustable workstation, and a decorative feature.

A lower portion on the outer side of the rotation module may comprise of the fireplace feature. The fireplace feature may comprise of a television inserted into a rectangular opening having an appearance of a fireplace. The television allows normal television viewing and mimics an active burning fire when using a fire display programming such as an Amazon Firestick. A mantle may be configured on a top portion of the fireplace feature. The fireplace feature may be a removable feature such that it may be removed from the outer side of the rotation module allowing the fireplace to be moved to a different part of the room.

Another fixture that may comprise part of the outer side of the rotation module is the adjustable workstation. The adjustable workstation may be configured relatively near a middle of the rotation module immediately above the fireplace feature. The adjustable workstation may comprise of a desktop that pivots to open and close, and a height of the desktop is adjustable. When not in use, the workstation folds vertically to rest parallel to the rotation module. To use, the workstation is folded downward and rests perpendicular to the rotation module. The workstation may slide up or down to accommodate a preferred height of using the workstation, in essence allowing a user to sit or stand at the workstation. One or more power outlets may also be integrated into the rotation module wall relatively proximate to the workstation.

An upper portion of the outer side of the rotation module, which is relatively above the workstation may comprise of other decorative or usable features. Non-limiting examples of decorative or usable features may include, and not be limited to, shelving, mirror, artwork, or other wall decoration.

In this respect, before explaining the current embodiments of the wall bed with the removable fireplace and the adjustable workstation in detail, it is to be understood that the wall bed with the removable fireplace and the adjustable workstation is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall bed with removable fireplace and adjustable workstation.

It is therefore important that the claims be regarded as including such equivalent construction insofar as they do not depart from the spirit and scope of the wall bed with removable fireplace and adjustable workstation. It is also to be understood that the phraseology and terminology employed herein are for purposes of description and should not be regarded as limiting.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
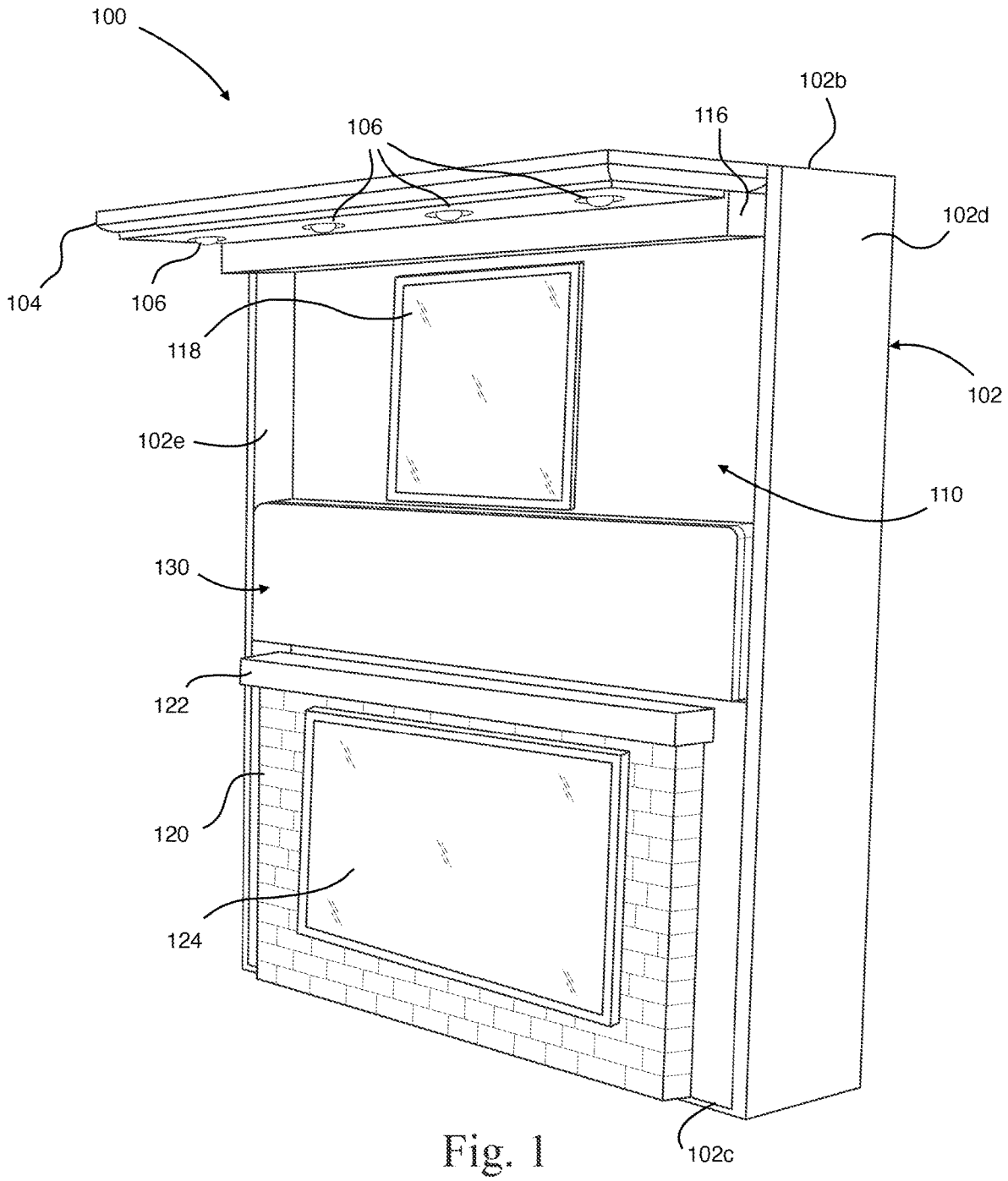
FIG. 1 depicts an illustration of a perspective view of a wall bed system.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

Where reference is made herein to a method comprising two or more defined steps, the defined steps may be carried out in any order or simultaneously (except where the context excludes that possibility), and the method may include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

Figure 2:
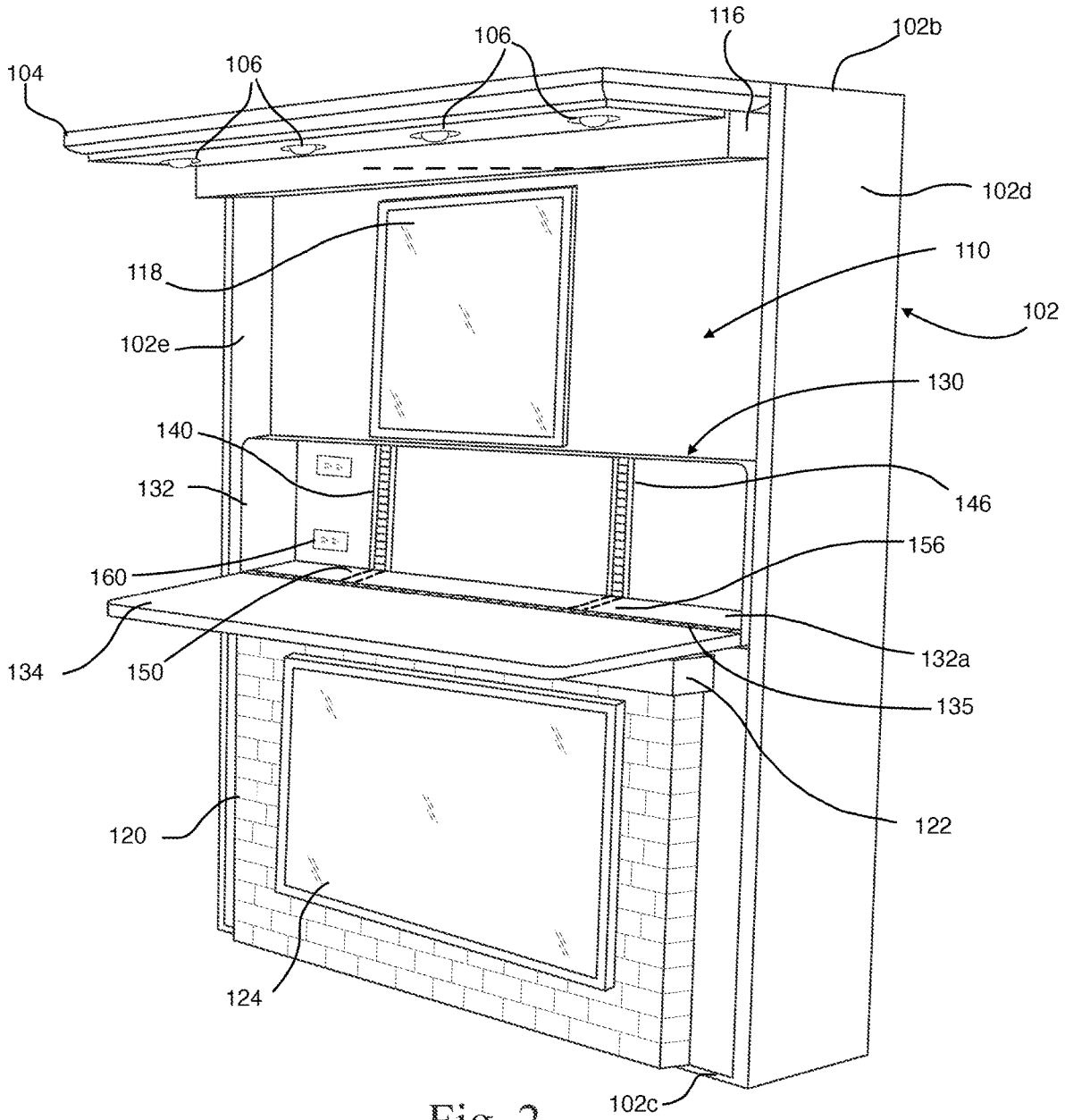
FIG. 2 depicts an illustration of the wall bed system with an adjustable workstation in an open position.
Figure 3:
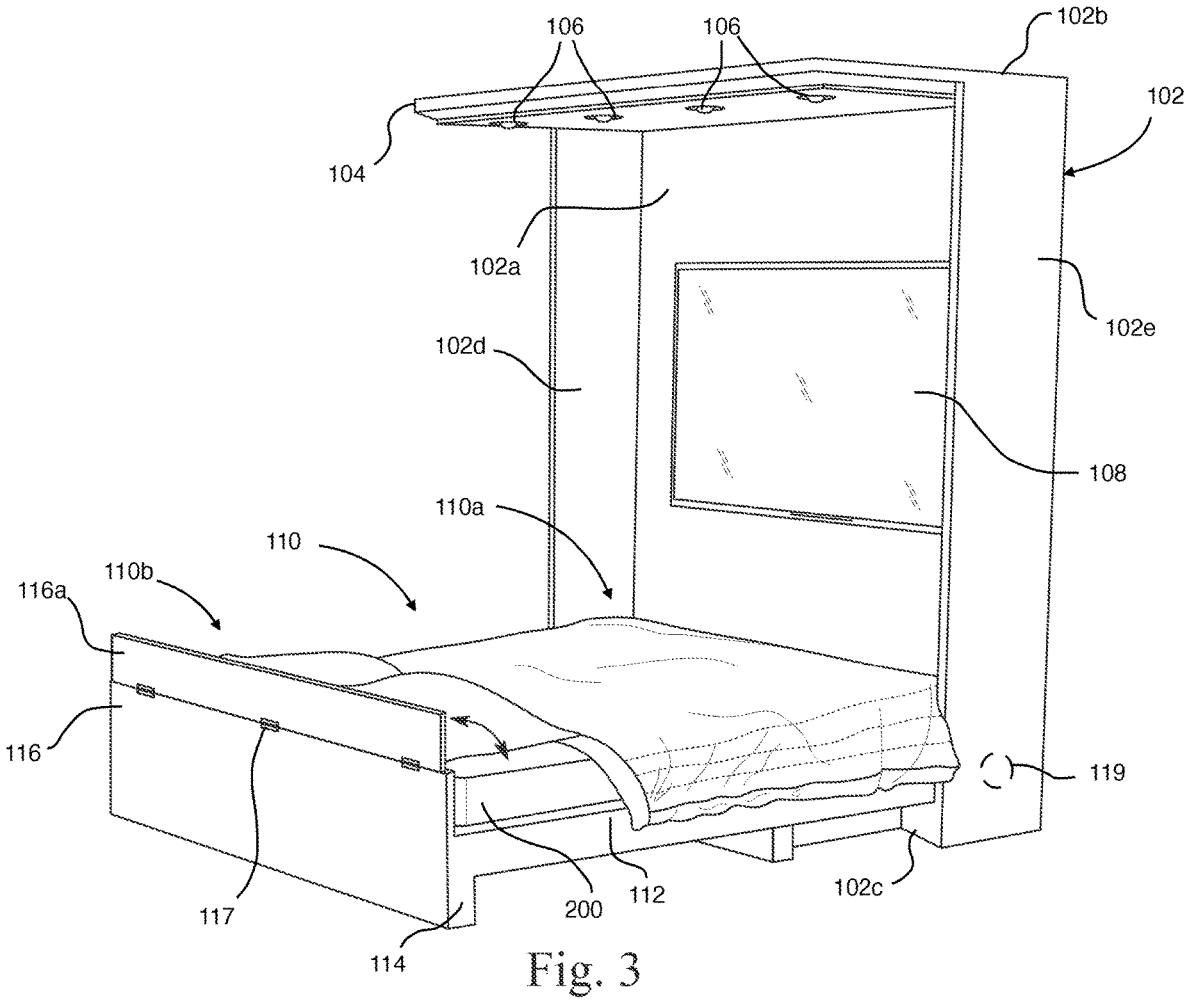
FIG. 3 depicts an illustration of the wall bed system with a rotation module in a lowered and horizontal position.

In referring to the figures, a non-limiting embodiment of a wall bed system is illustrated in FIGS. 1 through 5 and generally indicated as a wall bed 100. The wall bed 100 of the present invention is designed to function and serve several purposes including and not limited to an entertainment center, a bedroom, or an office and easily operable between these purposes with simple movements. FIGS. 1 through 3 illustrate a perspective view of a wall bed 100 in a closed position (FIGS. 1-2) and an open position (FIG. 3). The wall bed 100 is shown as comprising of a cabinet 102, a canopy 104, a rotation module 110, a fireplace 120, and an adjustable workstation 130. Thus, the wall bed 100 address a significant reduction in living space requirements and associated cost per square feet. The wall bed 100 also addresses the current trend of working from home. Additionally, the wall bed 100 also addresses accommodating group living arrangements.

As seen in the non-limiting embodiment in FIG. 1, the rotation module 110 is in a vertical closed position. In the closed position, an outer side of the rotation module 110 is visible and the fireplace 120 is presented, which is placed relatively in a lower half of the rotation module 110 outer side. In the closed position, the workstation 130 is accessible and positioned relatively adjacent to and above the fireplace 120. Additionally, an upper half of the rotation module 110 outer side may present additional fixtures and be referred to as upper fixture 118. As non-limiting examples, the upper fixtures 118 that may be presented on the upper half of the rotation module 110 may include and not be limited to a mirror, an artwork, or a shelf.

As shown in FIG. 1, the fireplace 120 may be described as a frame designed to have the appearance of a fireplace. As best seen in FIG. 1, the fireplace also comprises of a mantle 122. It is to be understood that the fireplace 120 may be presented without a mantle. The fireplace 120 and the mantle 122 are configured to be housed within a recessed section of the rotation module 110 or alternatively may be configured directly onto the rotation module 110 (recessed section not shown). The fireplace 120 unit is adapted to be easily mounted into the recessed section of the rotation module 110. In the preferred embodiment of the wall bed 100, the fireplace 120 is implemented to be removably extended into the recessed section of the rotation module 110 and seamlessly fit within the rotation module 110. In an alternate embodiment, the fireplace 120 may be designed and configured to be a permanent feature of the rotation module 102.

In the preferred embodiment, the fireplace 120 is configured to be a removable feature of the wall bed 100. In this embodiment, the fireplace 120 may be designed and configured with means to allow it to be easily mounted onto the recessed section and subsequently also be easily removed from within the recessed section in the rotation module 110. These means may include and not be limited to wheels that are connected to the bottom of the fireplace 120 such that it may be rolled into and out of the recessed area within the rotation module 110. The fireplace 120 also includes means to be secured within the recessed area such that when the rotation module 110 is moved into an open horizontal position the fireplace 120 stays within the recessed area.

As shown in FIG. 1, a television 124 is a removable part of the fireplace 120. The fireplace 120 is configured to securely accept the television 124 and hold it in place. The fireplace 120 may be designed with a bracket (not shown in the figures) to securely hold the television 124. Alternate variations to hold the television are also contemplated to be within the disclosure of this application. The television 124 would provide the function of a standard television enabled for audio, video, and television program viewing. The television 124 would also include an external source that includes a fireplace software which can be connected to the television 124 by a USB port located on the television 124 to display an active burning fire in a fireplace.

Referring to FIGS. 1 and 2, the rotation module 110 is in the vertical stowed position within the cabinet 102 and the workstation 130 is illustrated as being located on the outer side of the rotation module 110 and accessible for use. FIG. 1 illustrates the workstation 130 as being in a closed position, and FIG. 2 illustrates the workstation 130 as being in an open position. A desktop 134 comprising part of the adjustable workstation 130 may pivot down to an open position for use as a desk. As best seen in FIG. 3, with the desktop 134 of the adjustable workstation 130 pivoted back to a closed position, the rotation module 110 may be lowered to a horizontal position to expose a mattress 200 or use to lay on.

Also shown in FIGS. 1 and 2, the outer side of the rotation module 110 also comprises of the upper fixture 118, preferably in an area above the adjustable workstation 130. In the illustration, a mirror is presented as an example of the upper fixture 118 above the adjustable workstation 130, however other features are also contemplated. Additionally, with the rotation module 110 in the open horizontal position, an inside of the cabinet 102 is also shown to comprise of a fixture, referred to as cabinet fixture 108, wherein non-limiting examples may include a television, a mirror, and an artwork. The cabinet fixture 108 may be presented in a recessed area within the cabinet 102 such that the cabinet fixture 108 does not interfere with the bed 150 when the rotation module 110 is in a vertical position with the bed 150 stowed within the cabinet 102. Recessed areas of various sizes may be offered to accommodate cabinet fixtures 108 of different sizes.

The cabinet 102 of the wall bed 100 may be described as a furniture item comprising an open sided, rectangular box. The cabinet 102 is permanently affixed to a wall in a room with the open side facing toward the room (wall and room not shown in the illustrations). As best seen in FIG. 3, the cabinet 102 is formed by a cabinet wall 102*a* and four sides that extend perpendicularly from the cabinet wall 102*a*. The four sides include a cabinet top side 102*b*, a cabinet bottom side 102*c*, a cabinet left side 102*d*, and a cabinet right side 102*e*, which are coupled to and extend from the cabinet wall 102*a* at a top edge, a bottom edge, a left edge, and a right edge, respectively. The cabinet wall 102*a* is placed against a wall in a room such that the four sides extend away from the wall, wherein the cabinet top side 102*b* and the cabinet bottom side 102*c* are parallel to each other and the cabinet left side 102*d* and the cabinet right side 102*e* are parallel to each other.

The canopy 104 also comprises part of the wall bed 100. The canopy 104 may be coupled to the cabinet 102. As best seen in FIGS. 1 through 3, the canopy 104 may be coupled to the cabinet top side 102*b* such that the canopy 104 extends beyond the cabinet top side 102*b*, the cabinet left side 102*d*, and the cabinet right side 102*e*. The canopy 104 comprises one or more recessed lights 106 coupled to an underside of the canopy 104 (i.e., facing downward) and in a position that extends past the cabinet top side 102*b*. FIGS. 1 through 3 illustrate four recessed lights 106 coupled to the underside of the canopy 104, however, it is to be understood that one or more recessed lights may be coupled to the underside of the canopy 104. It is also to be understood that the canopy 104 may not comprise of lights. In alternate embodiments, the canopy 104 may also comprise of one or more speakers (not shown) in conjunction with the one or more recessed lights 106 or in lieu of the recessed lights.

Similar to the cabinet 102, the rotation module 110 may also be described as a furniture item comprising an outer side and an inner side. The outer side of the rotation module 110 faces toward a room and the inner side of the rotation module faces the cabinet 102 when the wall bed 100 is in the vertical closed orientation. As seen in FIGS. 1 through 3, the rotation module 110 may pivot between a vertical closed position and a horizontal open position. When the rotation module 110 is in the vertical closed position, the rotation module 110 and the cabinet 102 form an enclosed box. In this closed position, the workstation 130 and fireplace 120 may be accessible on the outer side of the rotation module 110. In the horizontal open position, the mattress 200 and the cabinet fixture 108 may be accessible.

As best seen in FIG. 3, a bedding arrangement may be accessible when the rotation module 110 is pivoted to the open position. The inner side of the rotation module 110 includes a mattress 200 that is stored vertically in the rotation module vertical position within the cabinet 102 when not in use. The rotation module 110 comprises of a bed frame 112 on top of which the mattress 200 is positioned. Further, the rotation module 110 may also comprise of one or more legs 114 and a footboard 116. The rotation module 110 may have a first end 110*a* and a second end 110*b*. It is to be understood that either end of the rotation module 110 in the open position may be used for a user's head and feet. The first end 110*a* of the rotation module 110 is relatively proximate the cabinet bottom side 102*c* in the vertical stowed position and remains within the cabinet 102 against the cabinet back wall 102*a* when in the horizontal rotation module 110 horizontal open position. The second end 110*b* is opposite the first end 110*a* and is relatively proximate the cabinet top end 102*b* when in the vertical stowed position and extends away from the cabinet 102 in the horizontal folding bed down position.

The rotation module 110 may pivot down to a horizontal open position for use as a bed. The rotation module 110 is coupled to the cabinet 102 with one or more hinges 119 which allow the rotation module 110 to pivot between the vertical and horizontal positions, and vice versa. The rotation module 110 is coupled to the cabinet right side 102*e* and the cabinet left side 102*d* (not visible in the figure due to the angle of the illustration) by the one or more hinges 119, wherein at least one hinge 119 is on each side. More specifically, the one or more hinges 119 are attached to and couple the first end 110*a* of the rotation module 110 to the cabinet 102 at a portion that is relatively closer to the cabinet bottom side 102*c* such that rotation module 110 may pivot at the one or more hinges 119 without any hinderance with the cabinet back wall 102*a*.

The rotation module 110 may be designed with the standard wall bed lift mechanisms that are currently known in the arts and any that may be available in the future. Some examples of standard wall bed lift mechanisms that are currently known in the arts include, and are not limited to, a piston lift mechanism and a spring lift mechanism (not shown in the figures). The piston lift mechanism may utilize either gas or air pressure in their function when lowering and lifting the wall bed. The mechanism is contained within the cabinet 102 and coupled to the rotation module 110. The spring lift mechanism may be a coil driven mechanism which generally consists of a heavy duty compressed steel spring system composed of several individual coils.

A fulcrum (not shown in the illustration), which is an enclosed box is configured and positioned at a bottom end of the cabinet and extends from a left side 102*d* to a right side 102*e* of the cabinet 102. The fulcrum is positioned relatively below where the cabinet 102 and the rotation module 110 are coupled to each other. The fulcrum is affixed at the bottom end of the cabinet to enclose any hardware mechanism (e.g., the wall bed lift mechanism) necessary to raise and lower the rotation module 110, electrical wiring, and offer support to the second end 110*b* of the rotation module 110 when the rotation module 110 is in a horizontal or lowered position.

The one or more legs 114 are coupled to the bed frame 112 at the second end 110*b* of the rotation module 110 and may orient and support the bed frame 112 and the mattress 200 when the rotation module 110 is in the horizontal down position. The bed frame 112 of the rotation module 110 may be dimensioned to match any standard bed mattress. As non-limiting examples, the bed frame 112 and the mattress 200 may be twin, twin XL, full, queen, king, or California king. Therefore, the wall bed 100 may also be dimensioned to match the standard bed mattress sizes and come in varying sizes.

As best seen in FIG. 3, the foot board 116 has an extendable portion 116*a* that allows a user to raise the foot board 116 above the mattress 200 with the extendable portion 116*a*. The extendable portion 116*a* may be hingedly connected to the foot board 116 with one or more hinges, referred to as one or more foot board hinges 117. The foot board extendable portion 116*a* may be folded up to extend the foot board 116 when the rotation module 110 is in the horizontal down position. Further, the extendable portion 116*a* may be folded down to allow the rotation module 110 to fit properly within the cabinet 102 when in the vertical stowed position.

FIGS. 1 and 2 illustrate the adjustable workstation 130 which is configured on the outer side of the rotation module 110 and is accessible for use when the rotation module 110 is in the vertical closed position. The adjustable workstation 130 may be configured relatively in a central position on the outer side of the rotation module 110 immediately above the fireplace 120. The adjustable workstation 130 may comprise of a desk frame 132 having four sides. A bottom side of the desk frame 132, referred to as a desk frame bottom side 132*a* is coupled to a desktop 134 by one or more hinges 135 such that the desktop 134 may be closed and opened at the one or more hinges 135 as shown in FIGS. 1 and 2 respectively. The desktop 134 pivots downward to open for use as a desktop surface and pivots upward to close and stow the desktop 134. In the closed position, the adjustable workstation 130 forms an enclosed box. One or more power outlets 160 are integrated within the adjustable workstation 130. As seen in FIG. 2, the one or more power outlets 160 are integrated on the outer side of the rotation module 110 and positioned within the adjustable workstation 130 such that a user may access them while working at the adjustable workstation 130.

The adjustable workstation 130 can be easily adjusted for either standing or sitting. The advantage being that a user may adjust a height of the adjustable workstation 130 to their preference. A variety of height adjustment mechanisms for the adjustable workstation 130 are within the disclosure of the present disclosure of the wall bed 100. Height adjustment mechanisms may include manual means of adjusting the height of the adjustable workstation 130 or include assistive means such as and not limited to hydraulic, electromechanical, electric, or pneumatic. An example of a manual means of adjusting the height of the adjustable workstation 130 is described below.

Referring to FIG. 2, an example of the height adjustment means for the adjustable workstation 130 is shown to comprise of a left desk track 140 and a right desk track 146 which are parallel tracks, vertically oriented, and mounted on the outer side of the rotation module 110 within the desk frame 132. Further, the adjustable workstation 130 comprises of a left height adjuster 150 and a right height adjuster 156 in a general location indicated in FIG. 2. The desktop 134 may be raised and lowered on the left desk track 140 and the right desk track 146. Specifically, the desk frame bottom side 132*a* may be coupled to the left height adjuster 150 and to the right height adjuster 156. The left height adjuster 150 may move up and down along the left desk track 140 and the right height adjuster 156 may move up and down along the right desk track 146 to move the desk frame bottom side 132*a* and the coupled desktop 134.

Figure 4:
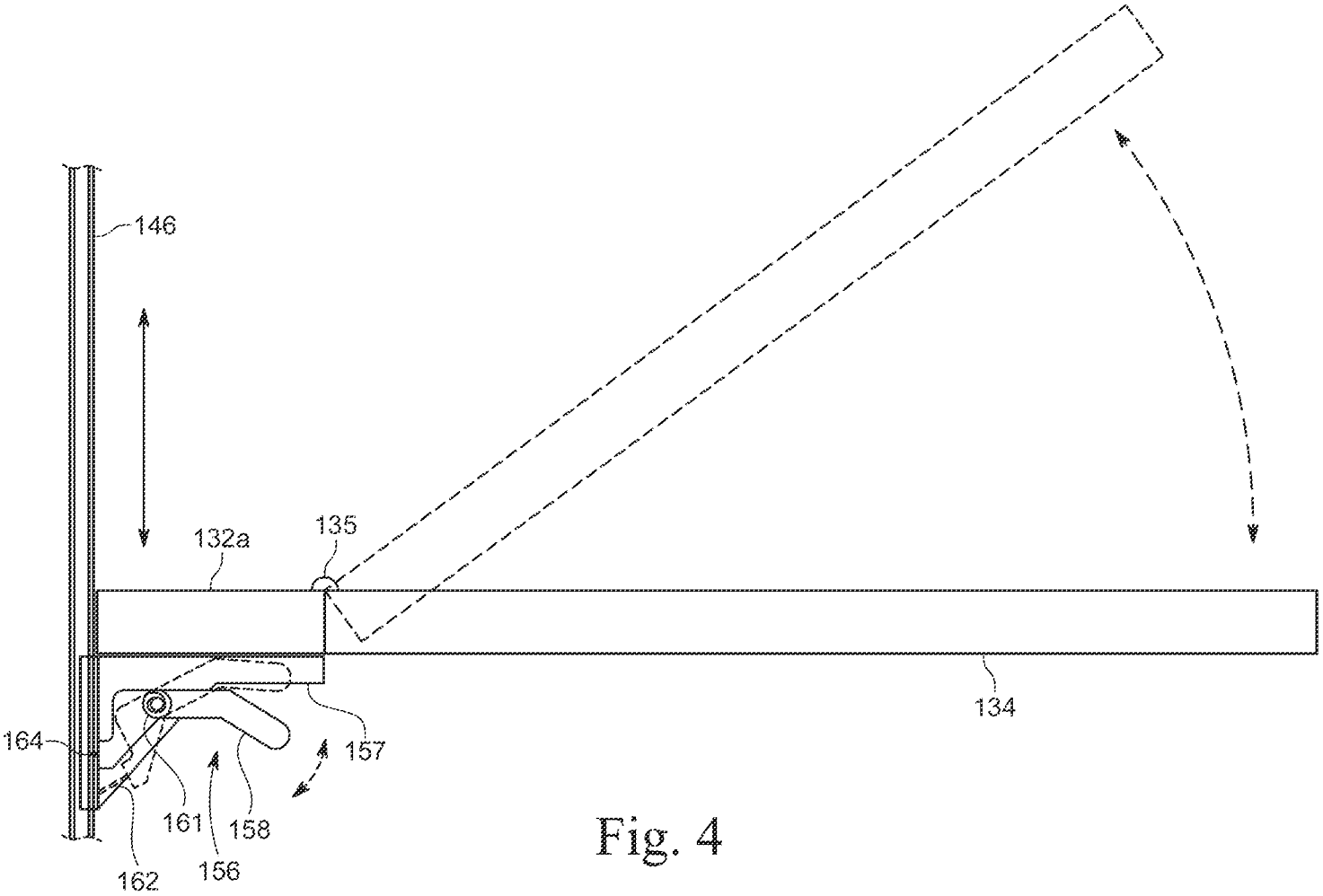
FIG. 4 depicts an illustration of a side view of a height adjuster for an adjustable workstation.
Figure 5:
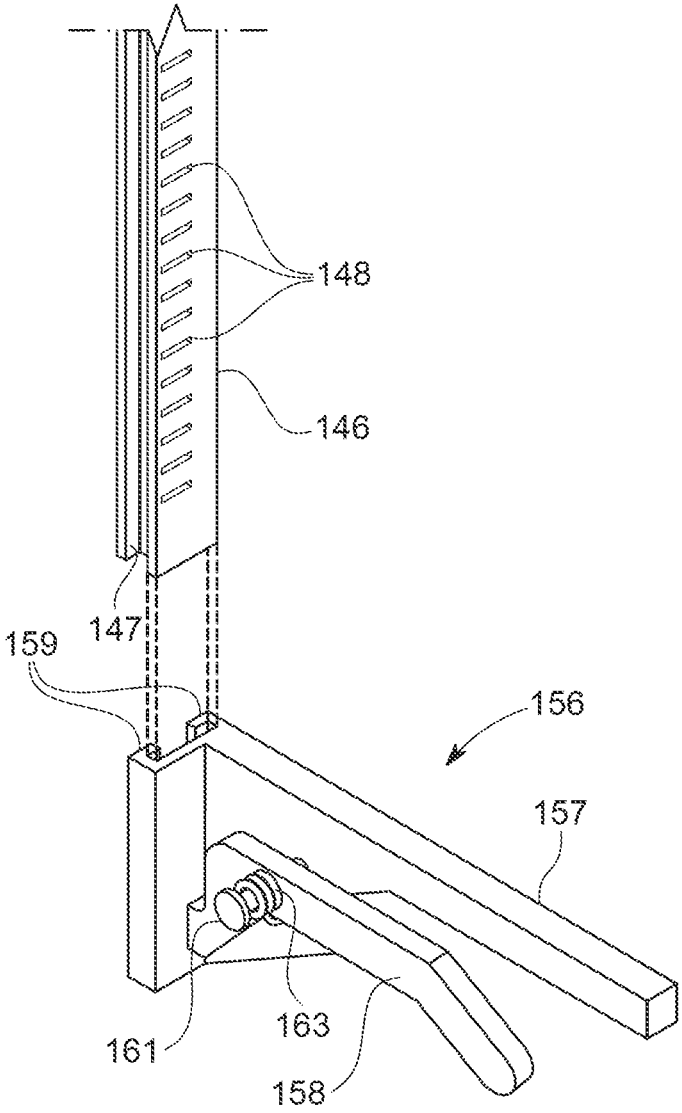
FIG. 5 depicts an illustration of a front view of the height adjuster for an adjustable workstation.

Referring to FIGS. 4 and 5, an individual selection of the right desk track 146 and the right height adjuster 156 are shown to further illustrate the mechanism of the adjustable workstation 130. It is to be understood that the exact same mechanism applies to the left desk track 140 and the left height adjuster 150. The right desk track 146 is shown to comprise a T-shaped rail 147 and a plurality of height adjustment slots 148. An individual height adjuster selected from the left height adjuster 150 and the right height adjuster 156 may slide along the individual desk track, namely the left desk track 140 and right desk track 146, respectively. The individual height adjuster may comprise a support bracket and a height adjustment handle. Referring to FIGS. 4 and 5, the right height adjuster 156 is illustrated to show a support bracket 157 and a height adjustment handle 158. The support bracket 157 may comprise a C-channel 159 that rides the right desk track 146. As shown in FIGS. 4 and 5, the support bracket 157 may extend towards the desktop 134 to support the desk frame bottom side 132*a*.

Referring back to FIGS. 4 and 5, the T- shaped rail 147 of the right desk track 146 is configured so as to present a T-shaped cross section that the C-channel 159 of the right height adjuster 156 may ride along. The plurality of height adjustment slots 148 may determine the heights available for the desktop 134. Specifically, a slide stop pin 162 from the right height adjuster 156 may engage one of the plurality of height adjustment slots 148 to fix the right height adjuster 156 at a specific height. As mentioned above, the left desk track 140 and the left height adjuster 150 comprise of the same features as described above for the right desk track 146 and the right height adjuster 156 and function exactly as described above.

The height adjustment handle 158 may pivotably couple to the support bracket 157 and may be operable to release the individual height adjuster from the individual desk track so that the height of the desktop 134 may be changed. Specifically, the height adjustment handle 158 may pivot at a pivot axis 161. When the height adjustment handle 158 that extends towards the desktop 134 is lifted, the height adjustment handle 158 may pivot and withdraw the slide stop pin 162 from the plurality of height adjustment slots 148 so that the height may be changed. A spring 163 may force the height adjustment handle 158 to pivot back to the starting position where the slide stop pin 162 extends through a pin aperture 164 in the support bracket 157 and into one of the plurality of height adjustment slots 148 to fix the newly selected height. In some embodiments, an underside of the desktop 134 (i.e., a side of the desktop that faces the floor when in the down position) may comprise pivoting, telescoping legs that extend toward a floor to support the front edge of the desktop 134 when opened.

In use, the wall bed 100 may provide a decorative element within a room when the rotation module 110 is in the vertical closed position wherein the mattress 200 on the inner side of the rotation module 110 is not accessible and is enclosed within the cabinet 102. Specifically, in this vertical closed position, the rotation module 110 may present the fireplace 120, the adjustable workstation 130, and the fixture 118 on the outer side of the rotation module 110. As described above, the fixture 118 may include and not be limited to a mirror, an artwork, or a shelving unit. When the rotation module 110 is in the horizontal open position, the mattress 200 is accessible for use as a bed. In the open position, the rotation module 110 may also present the cabinet fixture 108 which may include and not be limited to a television, an artwork, or a mirror.

Accordingly, the present description provides one or more embodiments for a useful wall bed system. It may be an advantage of the wall bed system, as described herein in one or more embodiments, that a user may maximize their living space with a functional bed that can transform from daytime use to nighttime use. In one exemplary embodiment, the wall bed system is provided with a fireplace that has an embedded television which can function both as a television and be used to display a fire via an external source connected to the television via its USB port. Additionally, the fireplace may be removed with ease and transferred to another part of the room. Another advantage of the embodiments described herein is the feature of an adjustable workstation so a user may work either standing up or sitting down to suit their preference. These features are not present in other wall bed systems. Thus, the wall bed system, as described in one or more non-limiting embodiments throughout this document, offers an improved device for functionally maximizing a small living space.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What may be claimed is:

1. A wall bed configured to function and serve a plurality of purposes as an entertainment center, a bedroom, or an office and easily operable between the plurality of purposes with simple movements, comprising:

a cabinet, wherein the cabinet is a furniture item comprising an open sided rectangular box having a cabinet wall, a cabinet top side, a cabinet bottom side, a cabinet left side, and a cabinet right side wherein the cabinet is affixed to a wall in a room;

a rotation module having an inner side and an outer side, wherein the rotation module is coupled to the cabinet and pivots between a vertical closed position and a horizontal open position, such that the rotation module and the cabinet form an enclosed box when the rotation module is in the vertical closed position with an inner side of the rotation module facing the cabinet and an outer side of the rotation module facing the room;

an adjustable workstation configured on the outer side of the rotation module, the adjustable workstation comprising:

a desk frame and a desktop, wherein the desktop is coupled to the desk frame, wherein the desktop is hingedly coupled to a desk frame bottom side such that the desktop pivots down to the open position and pivots up to a closed position;

a left desk track and a right desk track vertically oriented and parallel to each other, and mounted on the outer side of the rotation module within the desk frame:

a left height adjuster and a right height adjuster positioned below and coupled to the desk frame bottom side, wherein the left height adjuster is configured to connect to the left desk track and moves up and down along the left desk track, wherein the right height adjuster is configured to connect to the right desk track and moves up and down along the right desk track;

wherein the desktop coupled to the desk frame bottom side is raised and lowered on the left desk track and the right desk track; and wherein the rotation module contains a bed on the inner side of the rotation module which is accessible in the horizontal open position and the adjustable workstation is accessible in the vertical closed position.

2. The wall bed of claim 1, further comprising a fireplace wherein the fireplace includes a mantle, wherein the fireplace is configured to accommodate a television within the fireplace, wherein the television is used for standard television viewing and accepts an external source with a software program to simulate and display an active fireplace, and the fireplace is positioned on the outer side of the rotation module and accessible when the rotation module is pivoted to the vertical closed position.

3. The wall bed of claim 2, wherein the fireplace is a permanent feature on the outer side of the rotation module.

4. The wall bed of claim 1, wherein an individual desk track selected from the left desk track and the right desk track comprise a T-shaped rail and a plurality of height adjustment slots;

wherein an individual height adjuster selected from the left height adjuster and the right height adjuster comprises a support bracket and a height adjustment handle, wherein the support bracket comprises a C-channel wherein the T-shaped rail presents a T-shaped cross section that the C-channel of the individual height adjuster rides along;

wherein the plurality of height adjustment slots determines heights available for the desktop;

wherein a slide stop pin from the individual height adjuster engages one height adjustment slot of the plurality of height adjustment slots to fix the individual height adjuster at a specific height.

5. The wall bed of claim 4, wherein the height adjustment handle pivotably couples to the support bracket, wherein the height adjustment handle pivots at a pivot axis and is operable to release the individual height adjuster from the individual desk track so that the height of the desktop is changed.

6. The wall bed of claim 5, wherein the height adjustment handle pivots and withdraws the slide stop pin from the plurality of height adjustment slots so that the height is changed, and a spring forces the height adjustment handle to pivot back to a starting position where the slide stop pin extends through a pin aperture in the support bracket and into one height adjustment slot of the plurality of height adjustment slots to fix a newly selected height.

7. The wall bed of claim 1, wherein the rotation module comprises a bed frame and a mattress that are stored vertically within the cabinet when not in use;

wherein one or more legs coupled to a foot of the bed frame orient the bed frame and the mattress horizontally when rotation module is pivoted horizontally.

8. The wall bed of claim 7, wherein the rotation module further comprises of a foot board, wherein the foot board has an extendable portion that is hingedly connected to the foot board and is operable to fold upward to use as a foot board and fold downward to contain the rotation module in a vertical position within the cabinet.

9. The wall bed of claim 1, further comprising a canopy, wherein the canopy is coupled to the cabinet top side and comprises of one or more recessed lights coupled to an underside of the canopy.

10. A wall bed configured to function and serve a plurality of purposes as an entertainment center, a bedroom, or an office and easily operable between the plurality of purposes with simple movements, comprising:

a cabinet, wherein the cabinet is a furniture item comprising an open sided rectangular box having a cabinet wall, a cabinet top side, a cabinet bottom side, a cabinet left side, and a cabinet right side wherein the cabinet is affixed to a wall in a room and a canopy is coupled to the cabinet top side and comprises of one or more recessed lights coupled to an underside of the canopy;

a rotation module having an inner side and an outer side, wherein the rotation module is coupled to the cabinet and pivots between a vertical closed position and a horizontal open position, such that the rotation module and the cabinet form an enclosed box when the rotation module is in a vertical closed position with the inner side of the rotation module facing the cabinet and the outer side of the rotation module facing the room;

one or more hinges which pivots the rotation module between the vertical closed position and the horizontal open position, wherein the one or more hinges couple a first end of the rotation module to the cabinet at a portion relatively closer to the cabinet bottom side;

an adjustable workstation configured on the outer side of the rotation module, the adjustable workstation comprising:

a desk frame and a desktop, wherein the desktop is coupled to the desk frame wherein the desktop is hingedly coupled to a desk frame bottom side such that the desktop pivots down to the open position and pivots up to a closed position;

a left desk track and a right desk track vertically oriented and parallel to each other, and mounted on the outer side of the rotation module within the desk frame:

a left height adjuster and a right height adjuster positioned below and coupled to the desk frame bottom side, wherein the left height adjuster is configured to connect to the left desk track and moves up and down along the left desk track, wherein the right height adjuster is configured to connect to the right desk track and moves up and down along the right desk track;

wherein the desktop coupled to the desk frame bottom side is raised and lowered on the left desk track and the right desk track; and wherein the rotation module contains a bed on the inner side which is accessible in the horizontal open position and the adjustable workstation is accessible in the vertical closed position.

11. The wall bed of claim 10, further comprising a fireplace wherein the fireplace includes a mantle, wherein the fireplace is configured to accommodate a television within the fireplace, wherein the television is used for standard television viewing and accepts an external source with a software program to simulate and display an active fireplace, and the fireplace is positioned on an outer side of the rotation module and accessible when the rotation module is in the vertical closed position within the cabinet.

12. The wall bed of claim 11, wherein the fireplace is a permanent feature on the outer side of the rotation module.

13. The wall bed of claim 10, wherein an individual desk track selected from the left desk track and the right desk track comprise a T-shaped rail and a plurality of height adjustment slots;

wherein an individual height adjuster selected from the left height adjuster and the right height adjuster comprises a support bracket and a height adjustment handle, wherein the support bracket comprises a C-channel;

wherein the T-shaped rail presents a T-shaped cross section that the C-channel of the individual height adjuster rides along;

wherein the plurality of height adjustment slots determines the heights available for the desktop; and wherein a slide stop pin from the individual height adjuster engages one height adjustment slot of the plurality of height adjustment slots to fix the individual height adjuster at a specific height.

14. The wall bed of claim 13, wherein the height adjustment handle pivotably couples to the support bracket, wherein the height adjustment handle pivots at a pivot axis and is operable to release the individual height adjuster from the individual desk track so that the height of the desktop is changed.

15. The wall bed of claim 14, wherein the height adjustment handle pivots and withdraws the slide stop pin from the plurality of height adjustment slots so that the height is changed, and a spring forces the height adjustment handle to pivot back to a starting position where the slide stop pin extends through a pin aperture in the support bracket and into one height adjustment slot of the plurality of height adjustment slots to fix a newly selected height.

16. The wall bed of claim 10, wherein the rotation module further comprises of a foot board, wherein the foot board has an extendable portion that is hingedly connected to the foot board and is operable to fold upward to use as a foot board and fold downward to contain the rotation module in a vertical position within the cabinet.

* * * * *